US010595701B2

(12) United States Patent
Yamada

(10) Patent No.: US 10,595,701 B2
(45) Date of Patent: Mar. 24, 2020

(54) RAISING APPARATUS FOR CLEANING PORTION IN CLEANING TOOL AND RAISING METHOD FOR CLEANING PORTION IN CLEANING TOOL

(76) Inventor: Kikuo Yamada, Tokyo (JP)

( * ) Notice: Subject to any disclaimer, the term of this patent is extended or adjusted under 35 U.S.C. 154(b) by 1464 days.

(21) Appl. No.: 14/124,865

(22) PCT Filed: Jun. 29, 2012

(86) PCT No.: PCT/JP2012/004257

§ 371 (c)(1),
(2), (4) Date: Dec. 9, 2013

(87) PCT Pub. No.: WO2013/001840

PCT Pub. Date: Jan. 3, 2013

(65) Prior Publication Data

US 2014/0115917 A1 May 1, 2014

(30) Foreign Application Priority Data

Jun. 29, 2011 (JP) ..... 2011-144149

(51) Int. Cl.
*A47L 13/38* (2006.01)
*D06C 11/00* (2006.01)

(52) U.S. Cl.
CPC ..... *A47L 13/38* (2013.01); *D06C 11/00* (2013.01)

(58) Field of Classification Search
CPC ..... A46B 17/08; A47L 13/38; D06C 11/00; D06C 17/00; D06C 13/00; D06C 13/08; B32B 37/04; B29C 71/009; B08B 5/00; B08B 5/02; B08B 5/023; B08B 5/026
USPC ..... 15/21.1, 229.3; 26/29 R, 31, 8 R, 15 R
See application file for complete search history.

(56) References Cited

U.S. PATENT DOCUMENTS 1,557,750 A * 10/1925 Wenzel ..... D06C 11/00 26/34
4,145,787 A * 3/1979 Bastian ..... A46B 3/16 15/206
8,151,402 B2 * 4/2012 Takabayashi ..... A47L 13/20 15/209.1
9,849,638 B2 * 12/2017 Broad ..... B29C 71/009
(Continued)

FOREIGN PATENT DOCUMENTS

CN 1317442 A 10/2001
JP U 60-117894 8/1985
JP A 10-219525 8/1998
(Continued)

OTHER PUBLICATIONS

Jan. 7, 2014 International Preliminary Report on Patentability issued in International Patent Application No. PCT/JP2012/004257.
(Continued)

*Primary Examiner* — Laura C Guidotti
(74) *Attorney, Agent, or Firm* — Oliff PLC

(57) ABSTRACT

A raising device for a cleaning part in a cleaning tool and a raising method for a cleaning part in a cleaning tool are provided. The raising device is capable of raising the fibers of the cleaning part to a state in which waste can be collected. A raising device for raising the fibers in a fiber layer constituting a cleaning part in a cleaning tool is configured by providing a blowing part which blows compressed air at the fiber layer to raise the fibers of the fiber layer.

16 Claims, 9 Drawing Sheets

(56) References Cited

U.S. PATENT DOCUMENTS

| | | | | |
|---|---|---|---|---|
| 2008/0301920 | A1* | 12/2008 | Chadha | D06C 11/00 26/29 P |
| 2010/0154156 | A1 | 6/2010 | Takabayashi et al. | |

FOREIGN PATENT DOCUMENTS

| | | |
|---|---|---|
| JP | A 11-318791 | 11/1999 |
| JP | A 2005-247485 | 9/2005 |
| JP | A 2008-6260 | 1/2008 |

OTHER PUBLICATIONS

Partial Translation of JP U 60-117894.
Sep. 18, 2012 Search Report issued in International Patent Application No. PCT/JP2012/004257 (with translation).

* cited by examiner

RAISING APPARATUS FOR CLEANING PORTION IN CLEANING TOOL AND RAISING METHOD FOR CLEANING PORTION IN CLEANING TOOL

TECHNICAL FIELD

The present invention relates to a raising apparatus for a cleaning portion in a cleaning tool and a raising method for a cleaning portion in a cleaning tool.

BACKGROUND ART

A cleaning tool for wiping up and sweeping waste such as dirt and dust attached to a floor or wall has been widely used. The cleaning tool includes a cleaning portion made of a large number of fibers on a base material sheet formed of a non-woven fabric. When the cleaning portion is allowed to come into contact with the floor or wall for wiping, waste is gathered between the fibers of the cleaning portion. In recent years, various types of cleaning tools are provided. For example, a cleaning tool in which fiber bundles joined to one surface of a base material sheet are wound around a pedestal mounted to the tip end of a handle, or a cleaning tool in which a plurality of base material sheets having fiber bundles joined thereto are superimposed to form a bag-like body having a handle insertion opening and a handle is inserted into the handle insertion opening is used.

The cleaning tool is manufactured by sequentially drawing long bodies as the base material sheets, arranging the fiber bundles made by laminating a large number of fibers on the drawn long bodies, joining the long bodies and the fiber bundles at each predetermined interval by heat sealing or the like, and cutting the fiber bundles and the long bodies between the heat-sealed joined portions by a cutter or the like. Here, the fiber bundles joined to the base material sheet function as the cleaning portion that collects waste.

However, the cleaning tool manufactured as above is in a state in which the fibers of the cleaning portion lie down in a predetermined direction, and there is a problem in that effectively collecting waste is difficult.

Therefore, in recent years, the fibers of the cleaning portion are raised to enhance the ability to collect waste. As a method of raising the fibers, for example, a method of rotating a roller having a large number of needles on the surface to come into contact with the surface of the cleaning portion thereby raising the fibers, or a method of pressing a bar such as a stainless steel to apply a resistance to a non-woven fabric and cutting the fibers or unraveling the tangled fibers thereby raising the fibers is known. In addition, a manufacturing apparatus for raising a cleaning portion using such methods is also known (for example, Patent Literature 1).

CITATION LIST

Patent Literature

Patent Literature 1: JP 11-318791 A

SUMMARY OF INVENTION

Technical Problem

However, in the manufacturing method and the manufacturing apparatus described in Patent Literature 1, since the fibers are raised by applying a resistance to the non-woven fabric of the cleaning portion, there is a problem in that an excessive resistance is applied to the fibers, the fibers are cut, and the ability of the cleaning portion to collect waste is significantly degraded. Particularly, many fibers constituting the cleaning portion have small fiber diameters and long lengths, and thus there is a problem in that there is concern of the fibers being cut only by applying a small force or load thereto. In addition, in the manufacturing method and the manufacturing apparatus described in Patent Literature 1, it is very difficult to adjust the frictional resistance applied to the fibers to an arbitrary magnitude, and in order to enable the adjustment, the number of manufacturing processes is increased, resulting in the problem of manufacturing cost increase.

The invention has been made taking the foregoing problems into consideration, and an object thereof is to provide a raising apparatus for a cleaning portion in a cleaning tool capable of raising fibers of the cleaning portion without degrading an ability to collect waste, and a raising method for a cleaning portion in a cleaning tool.

Solution to Problem

This invention is a raising apparatus for a cleaning portion in a cleaning tool, which raises fibers of the cleaning portion in the cleaning tool, comprising: a blowing part which blows gas toward fiber layers constituting the cleaning portion to raise the fibers of the fiber layers.

In the invention, it is preferable to be constructed that a transporting section which transports the cleaning tool be further included, a pin member that supports the cleaning tool provided in the transporting section, and the blowing part which includes a nozzle having a blowing hole for blowing the gas toward the fiber layers of the cleaning tool, and a driving device for moving the nozzle so as to allow the nozzle to blow the gas all over the fiber layers.

In addition, in the invention, it is preferable to be constructed that a detaching part for removing the cleaning tool mounted to the pin member by ejecting gas toward the cleaning tool of which the fibers of the fiber layers are raised by the blowing part.

In addition, in the invention, it is preferable to be constructed that the transporting section is provided which includes a belt member that transports the cleaning tool, a driving roller that transports the belt member, and a driven roller that allows the belt member to be overlaid thereon together with the driving roller; a pressing section is provided to press and fix the cleaning tool transported by the belt member against the belt member, and the blowing part includes the nozzle having the blowing hole for blowing the gas toward the fiber layers of the cleaning tool, and the driving device for moving the nozzle so as to allow the nozzle to blow the gas all over the fiber layers. In addition, in the invention, it is preferable to be constructed that the nozzle includes at least a first nozzle that is movable in a predetermined direction and a second nozzle that is movable in a direction intersecting the movement direction of the first nozzle, and the driving device is configured to allow the first nozzle to reciprocate in the predetermined direction and to allow the second nozzle to reciprocate in the direction intersecting the movement direction of the first nozzle.

In addition, the invention is a raising method for a cleaning portion in a cleaning tool, by which fibers of the cleaning portion in the cleaning tool are raised, the raising method is characterised by supporting and transporting the cleaning tool by a pin member; and blowing gas toward fiber layers constituting the cleaning portion from a nozzle provided in a blowing part, thereby raising the fibers of the fiber layers. In the invention, it is preferable to be constructed that transporting the cleaning tool having the raised fibers to a downstream side in a transport direction by a transporting section after the fibers of the fiber layers are raised by blowing the gas toward the fiber layers; and removing the cleaning tool supported by the pin member from the pin member by a detaching part that ejects gas toward the transported cleaning tool. In addition, according to the invention, in the raising method for a cleaning portion, by which the fibers of the cleaning portion in the cleaning tool are raised, the cleaning tool is installed in the transporting section, the cleaning tool transported by the transporting section is pressed against the transporting section by a pressing section, and the fibers of the fiber layers constituting the cleaning portion are raised by blowing the gas from the nozzle provided in the blowing part toward the pressed cleaning tool.

In the invention, it is preferable to be constructed that after the gas is blown toward the cleaning portion by at least a first nozzle that moves in a predetermined direction, the gas is blown by a second nozzle that moves in a direction intersecting the movement direction of the first nozzle.

Advantageous Effect of Invention

According to the invention, since the fibers of the cleaning portion can be raised by blowing the gas toward the cleaning portion, an excessive external force or load is not applied to the fibers. Therefore, even in a case where the diameter of the fiber is small and the length of the fiber is long, it is possible to provide a cleaning tool capable of reliably preventing a concern of the fibers being cut and further reliably preventing the degradation in a waste collecting ability.

DESCRIPTION OF EMBODIMENTS

The configuration of a raising apparatus for a cleaning portion in a cleaning tool (hereinafter, simply referred to as a "raising apparatus") according to the invention will be described. In addition, "up", "down", "forward", "rearward", "left", and "right" in this specification refer to directions illustrated in FIG. 3. In addition, in this specification, a direction in which the cleaning tool is transported is referred to as a "transport direction", a side that the cleaning tool transported with respect to a certain position approaches is referred to as an "upstream side" of the position, and a side from which the cleaning tool transported with respect to a certain position becomes distant is referred to as a "downstream side" of the position. In addition, "front end", "rear end", "left", and "right" used to describe the configuration of a nozzle illustrated in FIGS. 2 and 8 refer to directions illustrated in FIGS. 2 and 8.

The configuration of a raising apparatus of a first embodiment according to the invention will be described with reference to FIGS. 1 to 4.

Figure 3:
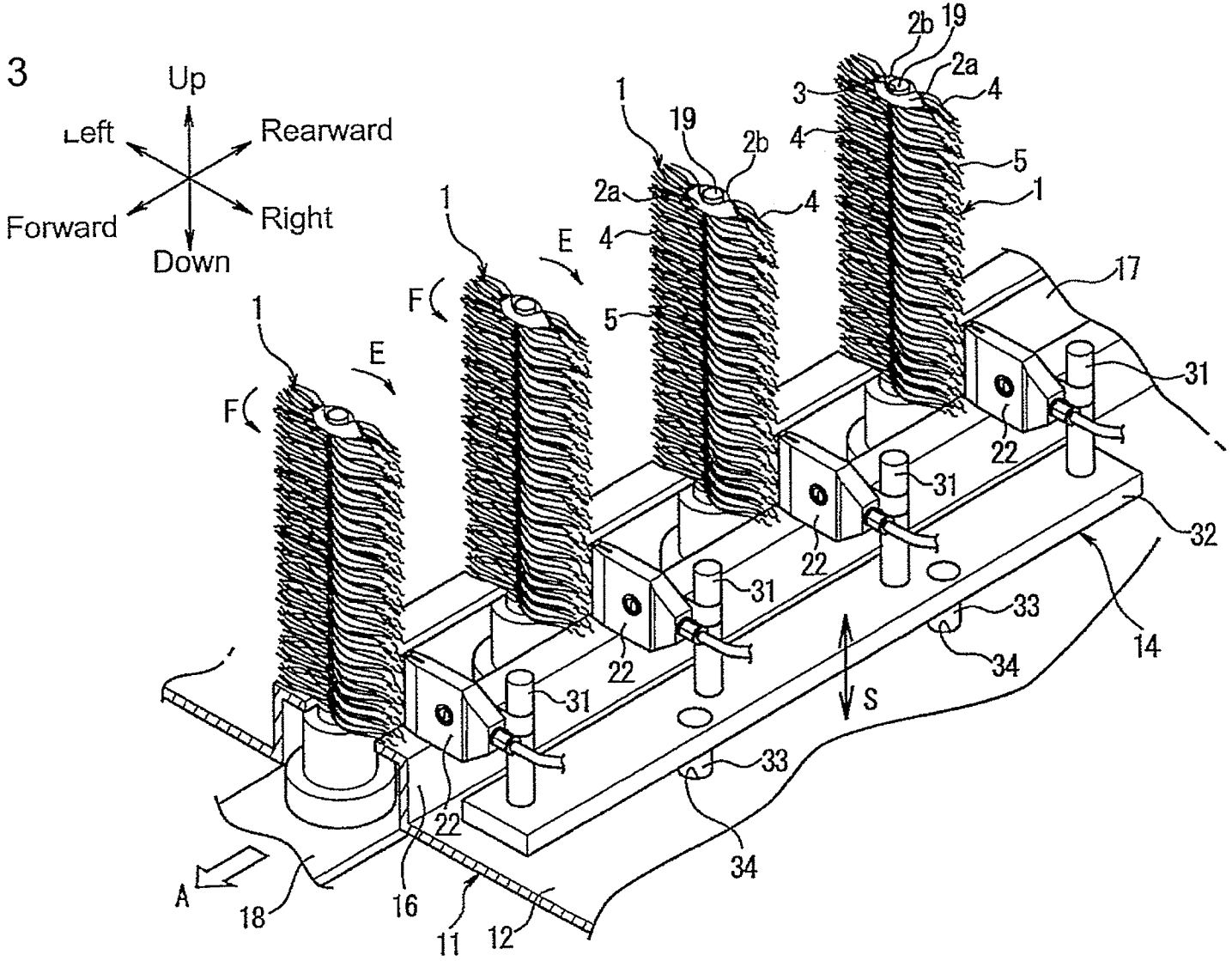
FIG. 3 is a perspective view illustrating a state before fibers of the cleaning portion are raised in the raising apparatus for the cleaning portion in the cleaning tool according to the first embodiment.

In FIG. 3, reference numeral 1 denotes a cleaning tool detachably mounted to the raising apparatus. In the cleaning tool 1, two rectangular base material sheets 2*a* and 2*b* are superimposed, peripheral edge portions thereof in the longitudinal are joined by heat sealing or the like while both end portions thereof in the vertical direction (end portions along a direction orthogonal to the longitudinal direction) are open, and a bag-like pocket portion 3 is formed between the peripheral edge portions. In this embodiment, both end portions thereof in the vertical direction are open, but at least one thereof may be open. Fiber layers 4 made by integrating a large number of fibers in layers are joined onto the base material sheets 2*a* and 2*b*. The fiber layers 4 are an aggregate of the fibers formed to collect waste and constitute a cleaning portion 5 of the cleaning tool 1.

In addition, joining of the base material sheet 2*a* and the base material sheet 2*b* and joining of the base material sheets 2*a* and 2*b* and a fiber bundle 4 may be performed by thermal fusion, ultrasonic welding, adhesion, sewing, or the like. Otherwise, other methods may also be employed as long as the above-mentioned members can be joined to each other. The base material sheets 2*a* and 2*b* are preferably made of a non-woven fabric sheet. Examples of the non-woven fabric sheet used for the base material sheets 2*a* and 2*b* include spunlace non-woven fabric, spunbond non-woven fabric, thermal bonded non-woven fabric, through-air bonded non-woven fabric, and point bonded non-woven fabric, and the spunlace non-woven fabric, the thermal bonded non-woven fabric, and the like are preferably used. The non-woven fabric sheet constituting the base material sheets 2*a* and 2*b* may be configured from a single sheet or may also be configured by laminating the same type or different types of sheets. In addition, as the fibers constituting the fiber bundle 4, for example, natural fiber such as cotton or wool, synthetic fiber such as polyethylene, polypropylene, polyethylene terephthalate, nylon, or polyacrylic fiber, and conjugated fiber such as core-sheath type fiber, sea-island type fiber, or side-by-side fiber are used. Among these, the synthetic fiber or the conjugated fiber having thermal adhesiveness is preferable. Particularly, the core-sheath type conjugated fiber in which the core is made of polypropylene and the sheath is made of polyethylene is preferable because polyethylene forming the sheath has excellent thermal adhesiveness and polypropylene forming the core has body strength. Otherwise, as the fiber bundle 4, a long fiber bundle generally called tow, which is manufactured from polyethylene, polypropylene, nylon, polyester, rayon, and the like may also be used. Furthermore, the fibers used in the fiber bundle 4 may be crimped by mechanical crimping, heat crimping, or the like. In addition, the materials of the base material sheets 2*a* and 2*b* and the fiber bundle 4 are only examples, and other materials may also be used to form the base material sheet and the fiber bundle. For example, a film-like material or a material formed from paper may be used for the base material sheet.

Figure 1:
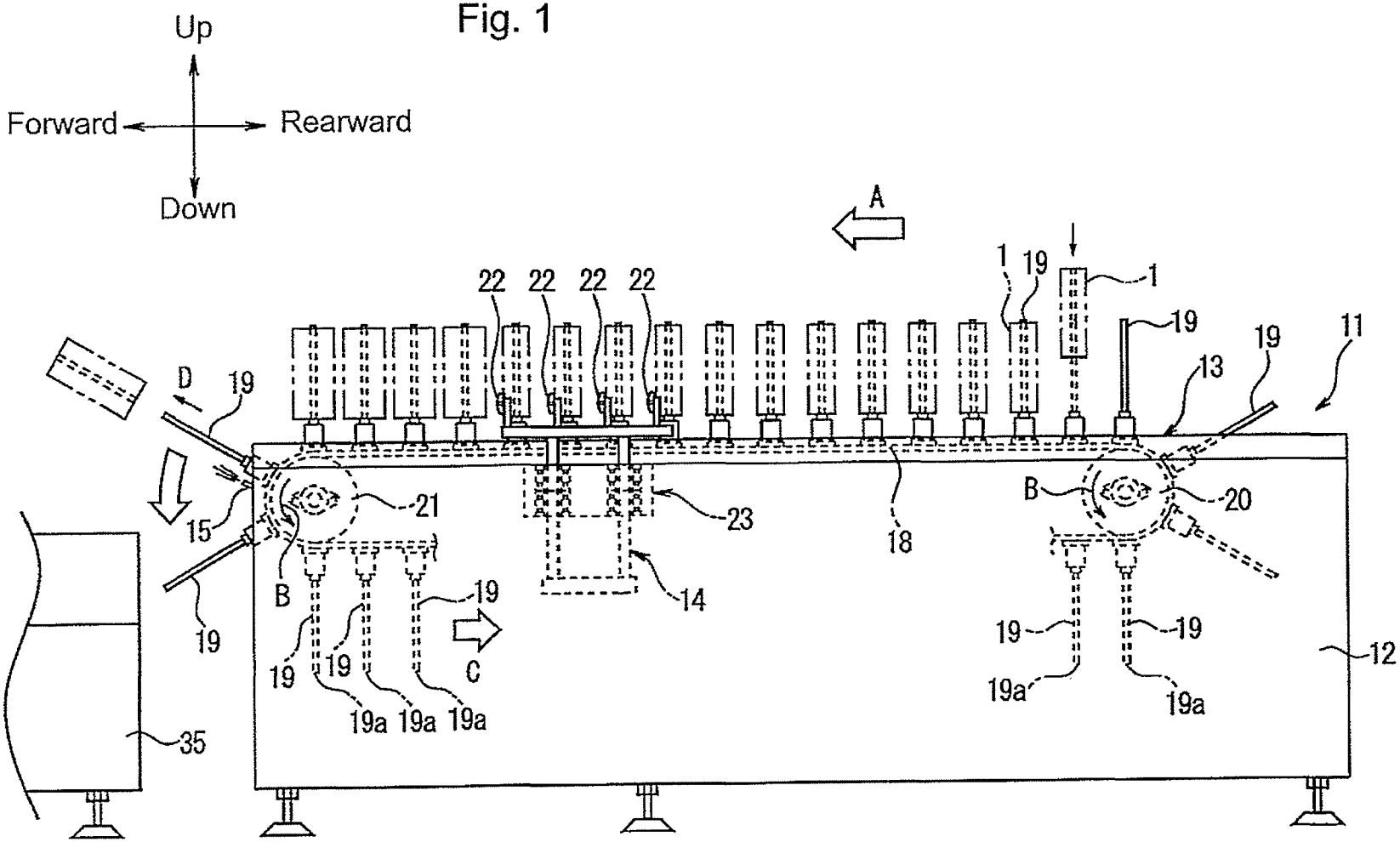
FIG. 1 is a front view illustrating the configuration of a raising apparatus for a cleaning portion in a cleaning tool according to a first embodiment of the invention.

Next, the configuration of a raising apparatus 11 according to this embodiment will be described. As illustrated in FIG. 1, the raising apparatus 11 according to this embodiment includes a base 12, a transporting section 13, a blowing part 14, and a removing portion 15. The base 12 is a base member of the raising apparatus 11 and is configured to install the transporting section 13, the blowing part 14, and the removing portion 15. In addition, as illustrated in FIGS. 1 and 3, at the upper portion of the base 12, two stepped portions 16 and 16 are formed to oppose each other. A predetermined interval is provided between the two opposing stepped portions 16 and 16, and the interval is formed as a transport path 17.

The transporting section 13 is for transporting the cleaning tool 1 and includes a transporting member 18, a driving roller 20, and a driven roller 21. The transporting member 18 is a member for transporting the cleaning tool 1, and in this embodiment, is formed as a belt-like member formed of rubber, synthetic resin, or the like. The belt-like member is formed so that the cross-section thereof in the right and left direction has a flat plate shape (see FIGS. 3 and 4). In addition, a plurality of pin members 19 are provided on the transporting member 18 at each predetermined interval. The pin member 19 is a columnar member formed of a metallic material such as stainless steel and is formed to have a curved front end. The pin member 19 is used to detachably mount the cleaning tool 1 and is formed to be inserted into the pocket portion 3 of the cleaning tool 1. In addition, in this embodiment, although the transporting member 18 is formed as the belt-like member formed of rubber, synthetic-resin, or the like, other materials may be arbitrarily selected to be used. Further, for example, a chain formed of rubber, synthetic resin, or the like may also be used as the transporting member 18. Although rubber, synthetic resin, or the like is used for the transporting member 18, other materials may also be used. In the case where the belt-like member is used as the transporting member 18, the configuration thereof may employ a hitherto well-known configuration. For example, a belt-like mold made of rubber may be used, or a layer configuration made by interposing a mesh-like member, a wire, or the like between rubbers may also be used.

The driving roller 20 is for transporting the transporting member 18, and in this embodiment, is installed in the base 12 so as to be positioned on the upstream side of a transport direction A. The driving roller 20 is configured to be rotated in a direction B in FIG. 1 by a driving motor (not illustrated). In addition, as the configuration of the driving motor and a mechanism for transmitting power from the driving motor to the driving roller 20, a hitherto well-known mechanism may be used.

The transporting member 18 is overlaid between the driving roller 20 and the driven roller 21. The driven roller 21 is installed in the base 12 so as to be positioned on the downstream side of the transport direction A. The driven roller 21 is installed so that the position thereof in the height direction is at the same position as the driving roller 20 and thus the pin member 19 provided on the transporting member 18 is moved in the horizontal direction.

When the driving roller 20 is rotated in the direction B in FIG. 1 by driving of the driving motor, the transporting member 18 overlaid between the driving roller 20 and the driven roller 21 is moved to revolve between the two rollers 20 and 21. By the revolving motion, the driven roller 21 is also rotated in the direction B in FIG. 1. When the transporting member 18 moves on a forward path of the revolving motion, that is, when the transporting member 18 moves in the direction A in FIG. 1, a front end portion 19*a* of the pin member 19 is directed upward. When the transporting member 18 moves on a return path of the revolving motion, that is, the transporting member 18 moves in a direction C in FIG. 1, the front end portion 19*a* of the pin member 19 is directed downward. In addition, in the illustration of FIG. 1, parts of the transporting member 18 and the pin member 19 that move in the direction C are omitted.

The blowing part 14 blows gas toward the fiber layers 4 constituting the cleaning portion 5 of the cleaning tool 1 to raise the fibers of the fiber layers 4. Air is preferable as the blown gas, but the blown gas is not limited to air and may use various types of gases such as nitrogen gas. As the blown gas, pressurized gas needed to raise the fibers is used. Hereinafter, embodiments is explained on the basis of shch compressed air. description.

Figure 2:
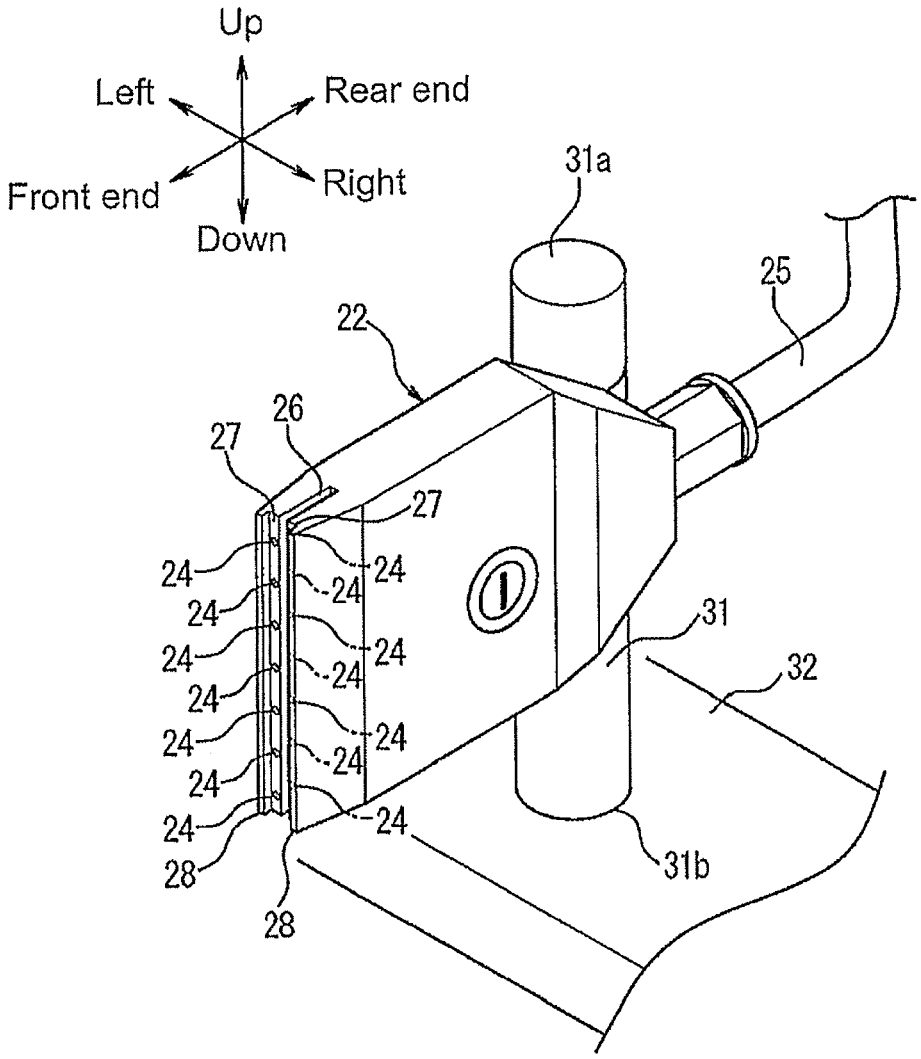
FIG. 2 is a perspective view illustrating the configuration of a nozzle of the raising apparatus for the cleaning portion in the cleaning tool according to the first embodiment.

The blowing part 14 includes nozzles 22 and a driving device 23. A plurality of the nozzles 22 are provided along the movement direction of the transporting member 18. As illustrated in FIG. 2, in the nozzle 22, blowing holes 24 are formed at the front end portion and a pipe 25 for supplying the compressed air is connected to the rear end portion. A groove portion 26 is formed at substantially the center portion in the right and left direction of the front end portion of the nozzle 22 so as to be cut from the front end side toward the rear end side. In addition, in the front end portion, blowing hole formation surfaces 27 are formed on both right and left sides of the groove portion 26, and a plurality of the blowing holes 24 are formed in the blowing hole formation surfaces 27 in the longitudinal direction. The blowing holes 24 are formed to have small hole diameters so as to increase the flow rate of the compressed air ejected from the blowing holes 24. In addition, the blowing holes 24 are formed so that the positions in the height direction of the blowing holes 24 formed on the left alternate with the positions in the height direction of the blowing holes 24 formed on the right and thus the positions in the height direction of the blowing holes 24 on the right and left are not positioned at the same positions. At both right and left ends of the front end portion of the nozzle, projections 28 are formed to protrude toward the front end side from the blowing hole formation surfaces 27. The projections 28 are formed to prevent the compressed air ejected from the blowing holes 24 from flying out. The hole diameters of the blowing holes 24 may be the same or may be different.

The driving device 23 includes a mechanism for enabling the nozzles 22 to move in the vertical direction so that the compressed air from the nozzles 22 is uniformly blown toward all over the fiber layers 4 in the vertical direction and uniform raising is achieved. The driving device 23 is configured to enable the nozzle 22 to reciprocate between a position corresponding to the upper end portion of the cleaning tool 1 and a position corresponding to the lower end portion of the cleaning tool 1. That is, the driving device 23 includes support bars 31 for mounting the nozzles 22, a support plate 32 that supports the support bars 31, driving shafts 33 connected to the lower side of the support plate 32, and a driving device (not illustrated) which allows the support plate 32 to vertically move by vertically moving the driving shafts 33 and thus allows the nozzles 22 to reciprocate in the vertical direction. In addition, the driving device is positioned below the upper surface of the base 12, and the support bars 31 and the support plate 32 are positioned above the upper surface of the base 12. The driving shafts 33 positioned between the support plate 32 and the driving device are disposed to penetrate through through-holes 34 that are open in the base 12, and the lower end of the driving shaft 33 is disposed to be positioned below the base 12.

A plurality of the support bars 31 are provided on the upper surface of the support plate 32 at predetermined intervals. As the material of the support bar 31, for example, various types of metallic materials such as stainless steel or aluminum may be used.

The plurality of the support bars 31 are mounted and fixed on the upper surface of the support plate 32 at predetermined intervals, and a plurality of the driving shafts 33 are mounted and fixed under the lower surface of the support plate 32 at predetermined intervals. The support plate 32 is for transmitting the reciprocating motion in the vertical direction transmitted by the driving shafts 33 to the support bars 31.

The driving shaft 33 is connected to the above-mentioned driving device and is configured to transmit the reciprocating motion in the vertical direction transmitted from the driving device to the support plate 32. As the material of the driving shaft 33, for example, various types of metallic materials such as stainless steel or aluminum may be used.

The nozzles 22 are installed at positions on the way in the direction A in which the cleaning tool 1 is transported by the transporting member 18 in FIG. 1, and the installation positions thereof are not particularly limited and the number of nozzles 22 installed may be appropriately selected.

As the above-mentioned driving device, a hitherto well-known device may be used. For example, a driving device which uses a motor as the driving source and has a structure in which the driving shafts 33 are reciprocated in the vertical direction (that is, the nozzles 22 are reciprocated in the vertical direction) by converting a rotating motion of the motor into a linear motion via a crank. In addition, in this embodiment, the nozzles 22 are reciprocated in the vertical direction, but the invention is not limited thereto. For example, in a case where the axial direction of the pin member 19 is disposed to be a horizontal direction, the nozzles 22 may be disposed to reciprocate in the horizontal direction other than the vertical direction. As such, the direction in which the nozzles 22 are reciprocated can be appropriately changed depending on the direction in which the pin members 19 are provided.

The removing portion 15 is for removing the cleaning tool 1 in which the fibers of the fiber layers 4 are raised by the above-mentioned blowing part 14 from the pin member 19. The removing portion 15 has a detaching nozzle for ejecting the compressed air supplied from a gas supply source toward the cleaning tool 1.

The removing portion 15 is provided in the vicinity of the driven roller 21. When the transporting member 18 is moved along the rotating motion of the driven roller 21, the axial direction of the pin member 19 is changed from a vertically upward direction to the horizontal direction and is further changed from the horizontal direction to a vertically downward direction. The compressed air is supplied from the removing portion 15 at an arbitrary angle in an area in which the axial direction of the pin member 19 is changed from the vertically upward direction to the horizontal direction, that is, an angle at which the axial direction becomes an inclined direction (a direction D in FIG. 1). The compressed air is ejected from the removing nozzle provided in the removing portion 15 in the inclined direction. By the ejection pressure of the compressed air, the cleaning tool 1 supported by the pin member 19 is taken out of the pin member 19, flies out in the direction D, and is removed. The compressed air may be ejected from the removing nozzle at a position at which the axial direction of the pin member 19 is directed to the horizontal direction. Reference numeral 35 in FIG. 1 is an accommodation portion for receiving the removed cleaning tool 1.

Next, the action of the raising apparatus 11 according to this embodiment will be described. As illustrated in FIG. 1, when the raising apparatus 11 starts to drive, the driving roller 20 starts to rotate in the direction B by the rotation of the driving motor (not illustrated). When the driving roller 20 starts to rotate in the direction B, the transporting member 18 starts to move accordingly and furthermore the driven roller 21 also starts to rotate in the direction B. An empty pin member 19 on which the cleaning tool 1 is not mounted is transported toward the driving roller 20 side (that is, the upstream side), and thus the pin member 19 is inserted into the pocket portion 3 of the cleaning tool 1 to allow the pin member 19 to detachably support the cleaning tool 1.

The cleaning tools 1 supported by the pin members 19 are sequentially moved in the direction A (transport direction) in FIG. 1 along the movement of the transporting member 18. In addition, when the cleaning tool 1 is positioned at a predetermined position, the rotational driving of the driving motor is stopped, and thus the movement of the transporting member 18 and the pin member 19 is stopped.

Next, the compressed air is supplied to the nozzles 22 of the blowing part 14 such that the compressed air is ejected from the blowing holes 24. At the same time, the driving device starts to drive, and the nozzles 22 start to reciprocate in the vertical direction (a direction S in FIG. 3). The ejected air is blown toward the entire fiber layers 4 constituting the cleaning portion 5 of the cleaning tool 1. The ejection pressure of the blown air is applied to the fiber layers 4 such that the fibers are raised. Accordingly, the fibers enter an erected state from the state where the fibers lie down. Here, since the compressed air is ejected from the plurality of the blowing holes 24 and the nozzles 22 are reciprocated in the direction S, turbulence of the compressed air is formed. Therefore, the compressed air is blown toward the fibers from all directions, and thus the fibers can be erected at all angles. In addition, the air that impacts with the fibers is dispersed and thus the air pressure is not concentrated on a single point. Therefore, an excessive load is not applied to the fibers and accordingly there is no concern of the fibers being cut.

Figure 4:
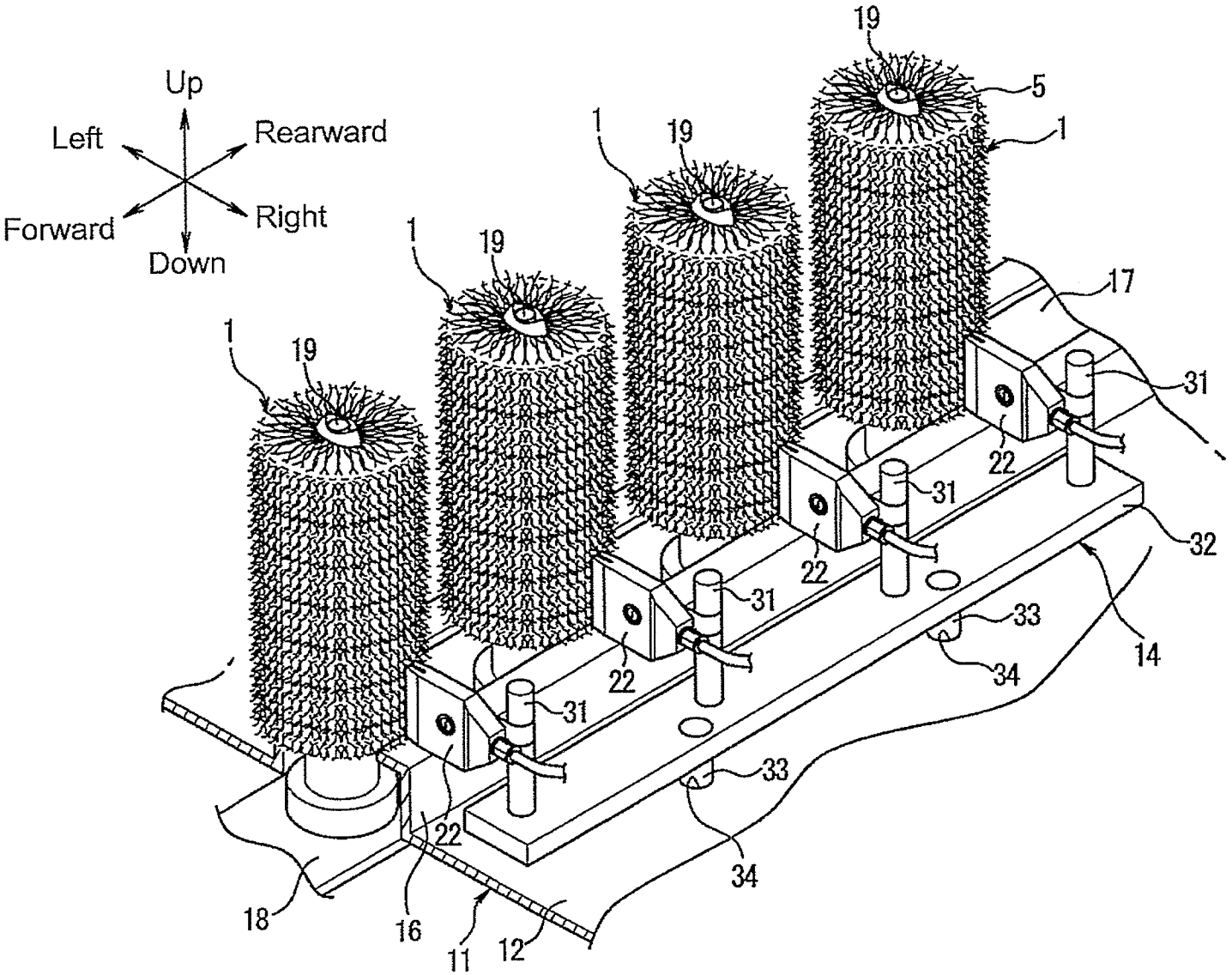
FIG. 4 is a perspective view illustrating a state after the fibers of the cleaning portion are raised in the raising apparatus for the cleaning portion in the cleaning tool according to the first embodiment.

In addition, since the cleaning tool 1 is rotatably supported by the pin member 19, the cleaning tool 1 to which the compressed air is blown from the plurality of the blowing holes 24 is rotated in a direction E or a direction F in FIG. 3 by the ejection pressure of the compressed air. As such, since the fibers of the fiber layers 4 are raised while the cleaning tool 1 is rotated in the direction E or the direction F, as illustrated in FIG. 4, the fiber layers 4 are raised by the compressed air over the entire peripheral surface. As a result, fiber layers having a round peripheral surface having a curved surface shape are formed.

When the raising of the fibers of the fiber layers 4 is completed, the driving motor starts rotational driving again, and accordingly the transporting member 18 and the pin member 19 start to move in the direction A. As such, when the cleaning tool 1 moved after being raised is displaced on the downstream side of the transport path 17, the transporting member 18 is moved along the outer peripheral surface of the driven roller 21. Therefore, the pin member 19 is also moved so that the front end thereof is directed in the normal direction at the outer peripheral surface of the driven roller 21. At the time point when the front end of the pin member 19 is directed in the normal direction at the outer peripheral surface of the driven roller 21 as such, the compressed air ejected from the nozzles of the removing portion 15 is blown toward the cleaning tool 1. As the compressed air is blown, a force in the direction D in FIG. 1 is applied to the cleaning tool 1, and the cleaning tool 1 is separated from the pin member 19 along the axial direction of the pin member 19 by the ejection pressure and flies out to be detached from the pin member 19.

The pin members 19 from which the cleaning tools 1 are detached are sequentially moved while the front ends are directed downward and are transported to the upstream side where the driving roller 20 is positioned. As described above, the cleaning tool 1 is newly mounted to the pin member 19, and thereafter, the above-described processes are repeatedly performed.

As described above, according to the raising apparatus according to this embodiment, the fibers of the fiber layers can be raised by blowing the compressed air toward the fiber layers, and thus an excessive external force is not applied to the fibers. Therefore, even in a case where the diameter of the fiber is small and the length of the fiber is large, there is no concern of the fibers being cut, and accordingly, the cleaning tool having an improved waste collecting ability can be manufactured.

In addition, according to the raising method according to this embodiment, turbulence is more likely to be formed by the compressed air. Therefore, the fibers of the cleaning portion can be raised evenly, and it is possible to achieve more efficient work. A holding handle is mounted to the cleaning tool having the raised fiber layers, which are manufactured as described above. Accordingly, a handy mop as a finished product is obtained.

Next, the configuration of a raising apparatus of a second embodiment according to the invention will be described with reference to FIGS. 5 to 9.

Figure 7:
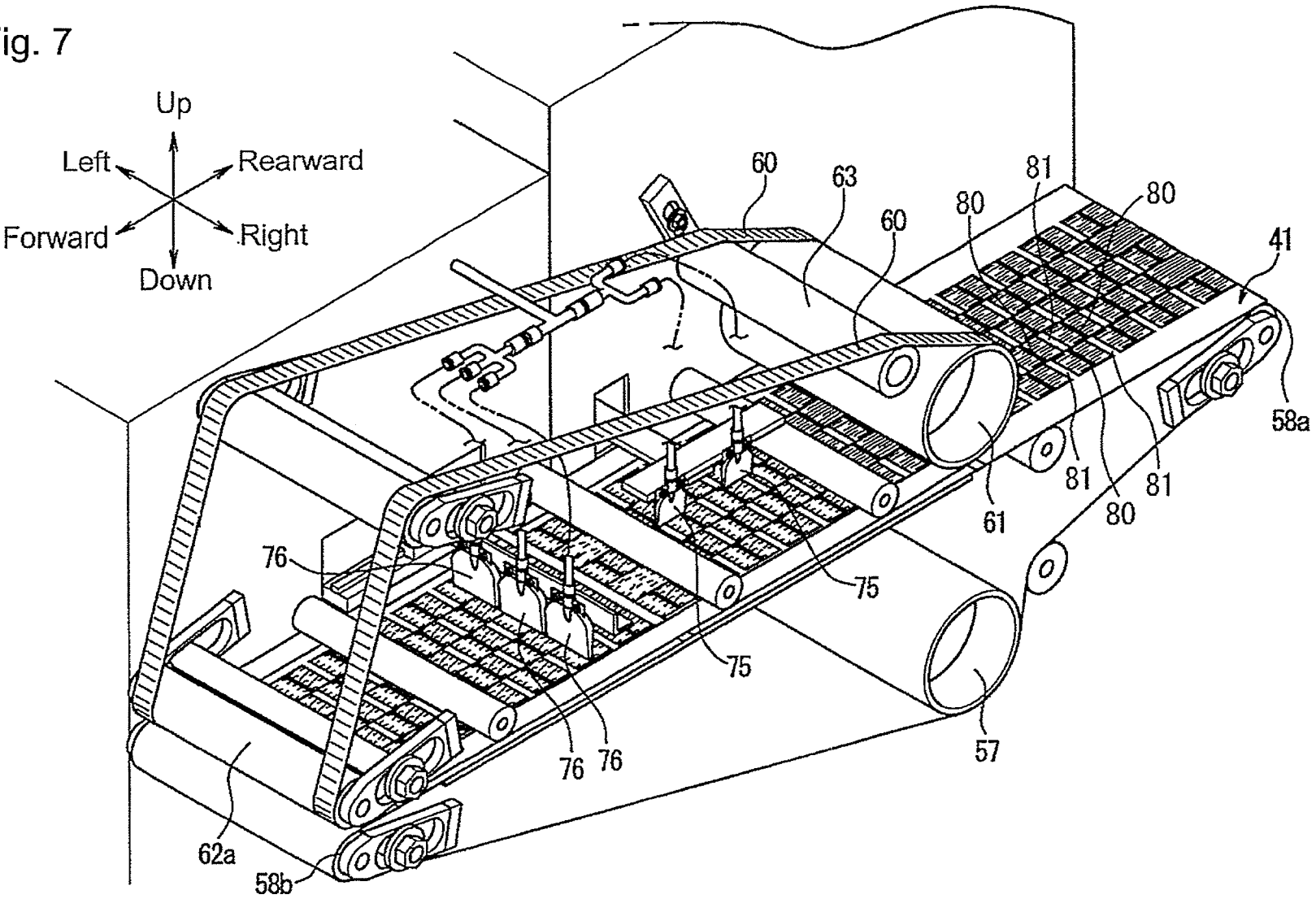
FIG. 7 is a perspective view illustrating the configuration of the raising apparatus for the cleaning portion in the cleaning tool according to the second embodiment.
Figure 8:
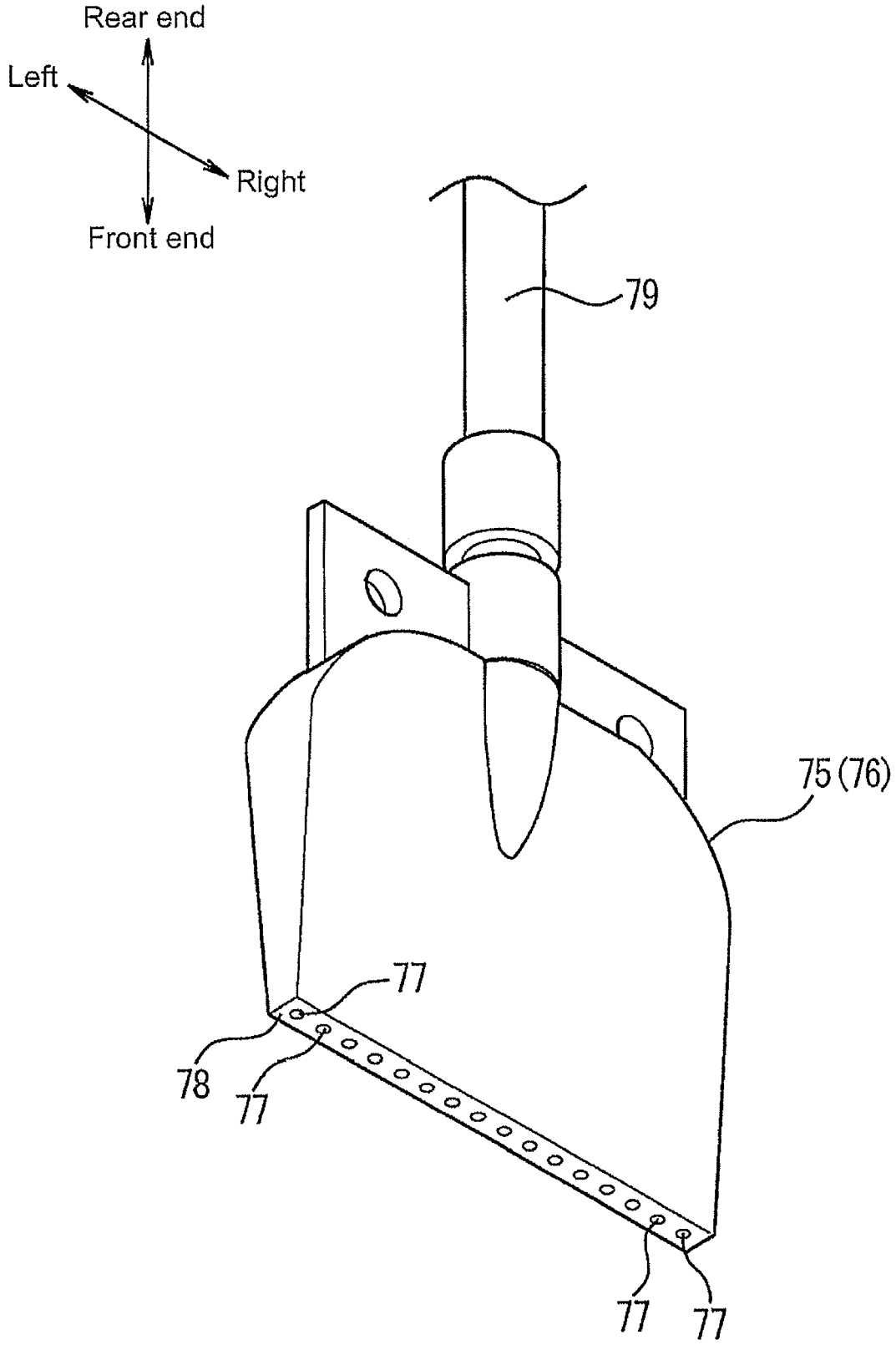
FIG. 8 is a perspective view illustrating the shape of a nozzle of the raising apparatus for the cleaning portion in the cleaning tool according to the second embodiment.
Figure 9:
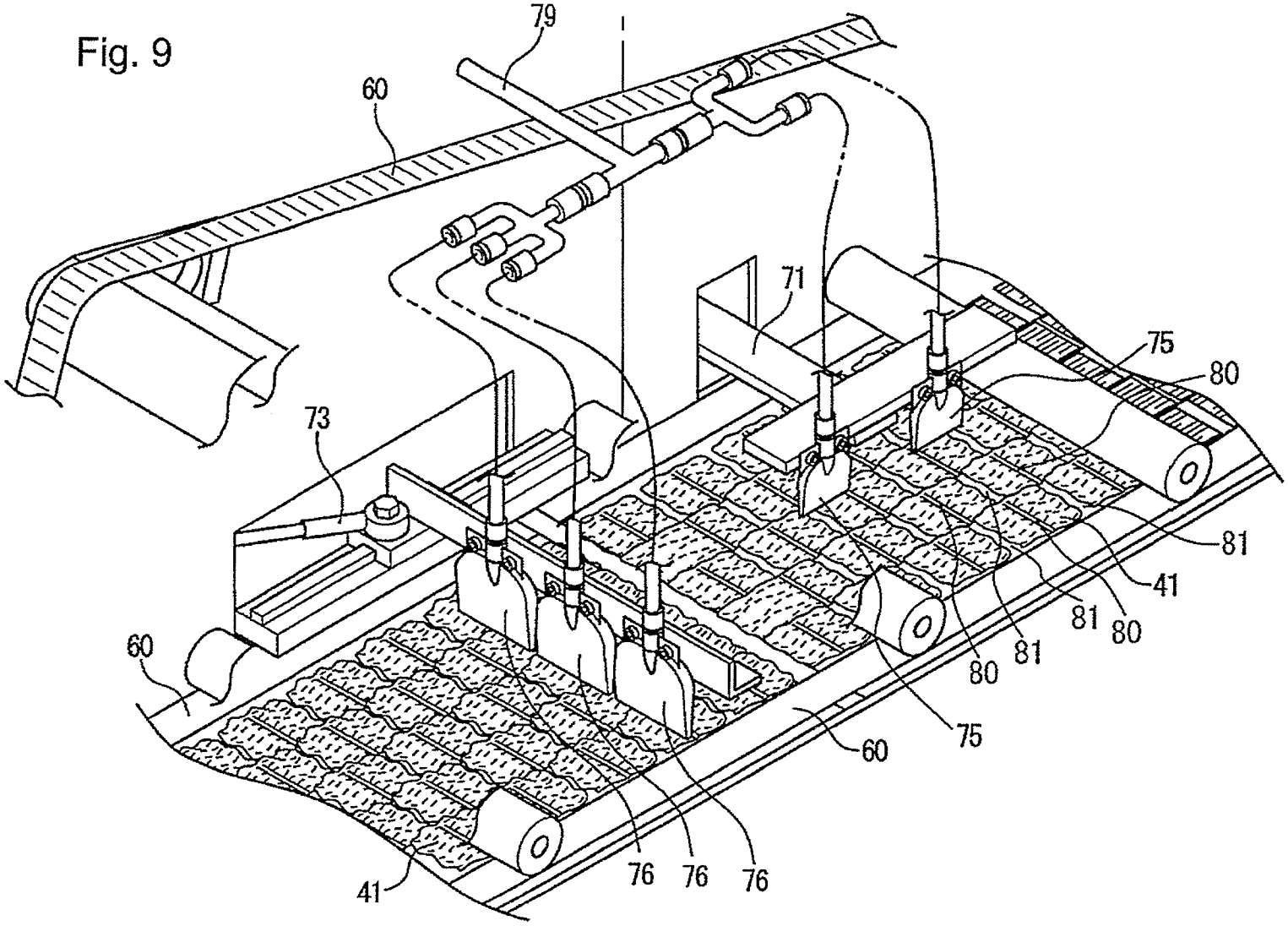
FIG. 9 is an explanatory diagram illustrating a state in which fibers of the cleaning tool are raised in the raising apparatus for the cleaning portion in the cleaning tool according to the second embodiment.

A cleaning tool 41 raised in this embodiment is used as a floor cleaning sheet, and is made by joining fiber layers 43 having a large number of fibers integrated onto a base material sheet 42 having predetermined dimensions. The fiber layers 43 constitute a cleaning portion 44 in the cleaning tool 41. When the floor cleaning sheet is mounted to the base plate of the front end of the cleaning tool, in order to fix the sheet to the base plate, the periphery of the end edge portion of the sheet is configured as a mounting portion in which the fiber layers 43 are not formed. The base material sheet 42 has a rectangular shape, and an aggregate of the fibers is placed on the base material sheet 42 excluding the area of the mounting portion. In addition, heat sealing is performed on a predetermined width in a direction orthogonal to the flow direction of the fibers at predetermined intervals, and at positions that alternate with the positions where the heat sealing is performed on the predetermined width, the heat sealing is performed in the same manner at predetermined intervals on the predetermined width. In this manner, as illustrated in FIGS. 7 and 8, heat sealed portions 80 having the predetermined width are formed in a zigzag pattern. In addition, by cutting the fibers at point of a predetermined length along the flow direction of the fibers from the heat sealed portions 80 as the base points (the base material sheet 42 under the fiber layers 43 is not cut), cut portions 81 are formed. The heat sealed portion 80 is positioned between the two cut portions 81 and 81. Therefore, the cut portions 81 are also formed to be arranged in the zigzag pattern. In this manner, the cleaning tool 41 is obtained in which the fiber layers 43 are joined onto the base material sheet 42 having the predetermined dimensions by the heat sealed portions 80 having the zigzag pattern and the cut portions 81 having the zigzag pattern are formed on the fiber layers 43. In the cleaning tool 41, the two cut portions 81 and 81 oppose each other with the heat sealed portion 80 interposed therebetween, and an area from the one cut portion 81 to the other cut portion 81 with the heat sealed portion 80 interposed therebetween forms a fiber layer block. That is, the cleaning tool 41 having the predetermined dimensions formed in the rectangular shape is made by forming a large number of fiber layer blocks on the base material sheet 42. This embodiment relates to a raising apparatus and a raising method for raising the fibers of the fiber layers 43 in the cleaning tool 41 having the above structure. In addition, a method of joining the base material sheet 42 to the fiber layers 43, a non-woven fabric that can be used as the base material sheet 42, the material used for the fibers constituting the fiber layers 43, and the like are the same as those of the first embodiment of the invention described above, and thus the description thereof will not be presented.

Figure 5:
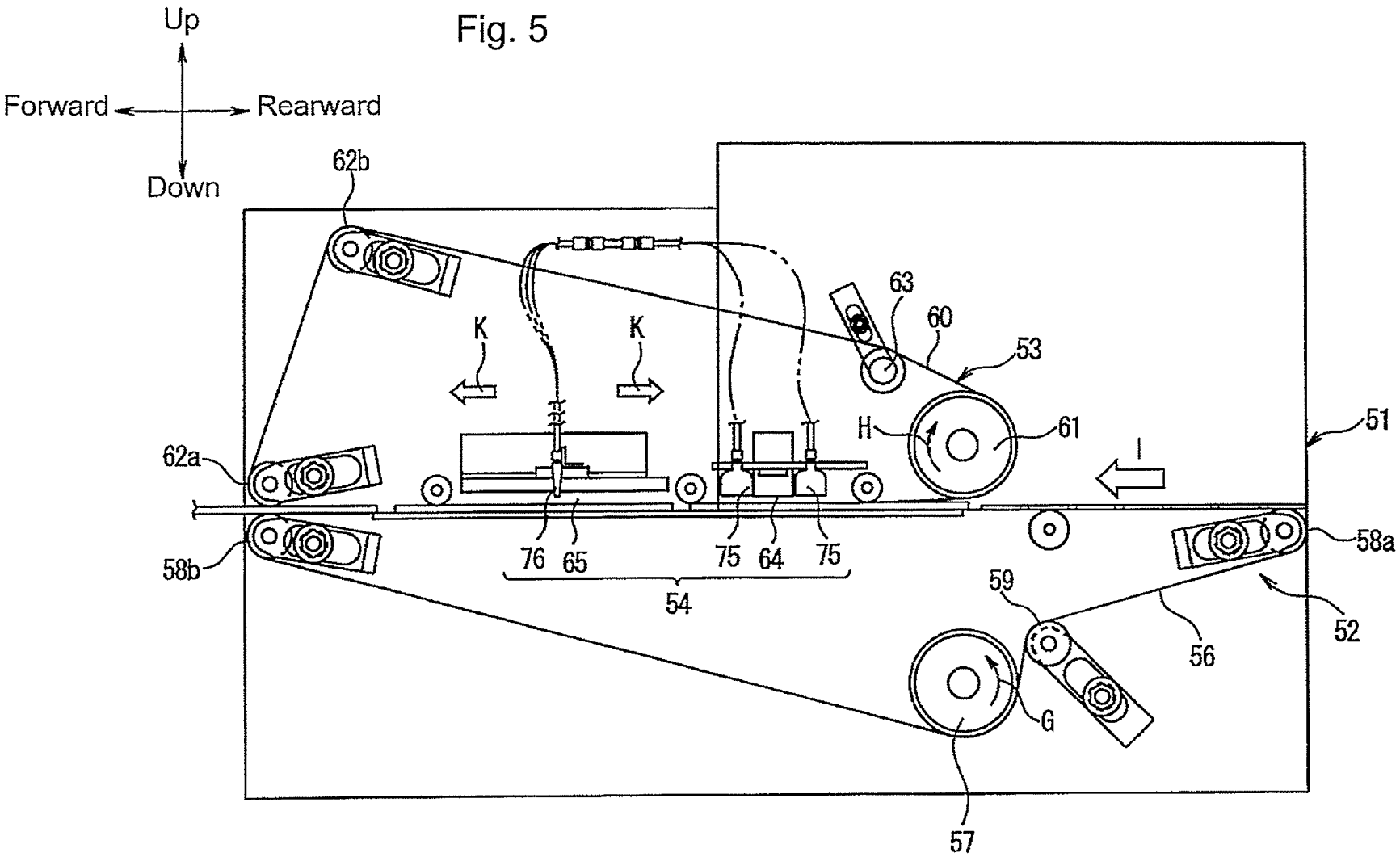
FIG. 5 is a front view illustrating the configuration of a raising apparatus for a cleaning portion in a cleaning tool according to a second embodiment of the invention.

The cleaning tools 41 having the predetermined dimensions configured as described above are continuously supplied to a transporting section 52 of the raising apparatus 51. As illustrated in FIG. 5, the raising apparatus 51 according to this embodiment includes the transporting section 52, a pressing section 53, a blowing part 54, and a driving device 55. The transporting section 52 includes a belt member 56, a driving roller 57, driven rollers 58*a* and 58*b*, and a tension roller 59. The belt member 56 is formed in a band shape having the same width as that of the cleaning tool 41 or having a greater width than that of the cleaning tool 41. The belt member 56 is overlaid by the driving roller 57 and the driven rollers 58*a* and 58*b* and is further configured to be applied a predetermined tension by the tension roller 59.

The driving roller 57 is for transporting the belt member 56 and is provided to be positioned at the lower portion of the inner peripheral side of the belt member 56. The driving roller 57 is configured to be rotated in a direction G in FIG. 5 by a driving motor (not illustrated). As the configuration of the driving motor and a mechanism for transmitting power from the driving motor to the driving roller 57, a hitherto well-known mechanism may be employed.

The driven rollers 58*a* and 58*b* are for overlaying the belt member 56 together with the driving roller 57 and are provided on the upstream side and the downstream side in the transport direction. The driven rollers 58*a* and 58*b* are installed so as to have the same position in the height direction and are disposed so that the belt member 56 transported between the driven rollers 58*a* and 58*b* is horizontally moved.

The tension roller 59 is for applying a predetermined tension to the belt member 56 overlaid by the driving roller 57 and the driven rollers 58*a* and 58*b*.

Regarding the belt member 56, the driving roller 57, the driven rollers 58*a* and 58*b*, and the tension roller 59, the belt member 56 revolves as the driving roller 57, the driven rollers 58*a* and 58*b*, and the tension roller 59 are rotated in the direction G in FIG. 5 by the driving of the driving motor (not illustrated). At this time, the revolving belt member 56 moves in a direction I in FIG. 5 at the portion the cleaning tools 41 are mounted on it, and are moved. The direction I is a transport direction.

Figure 6:
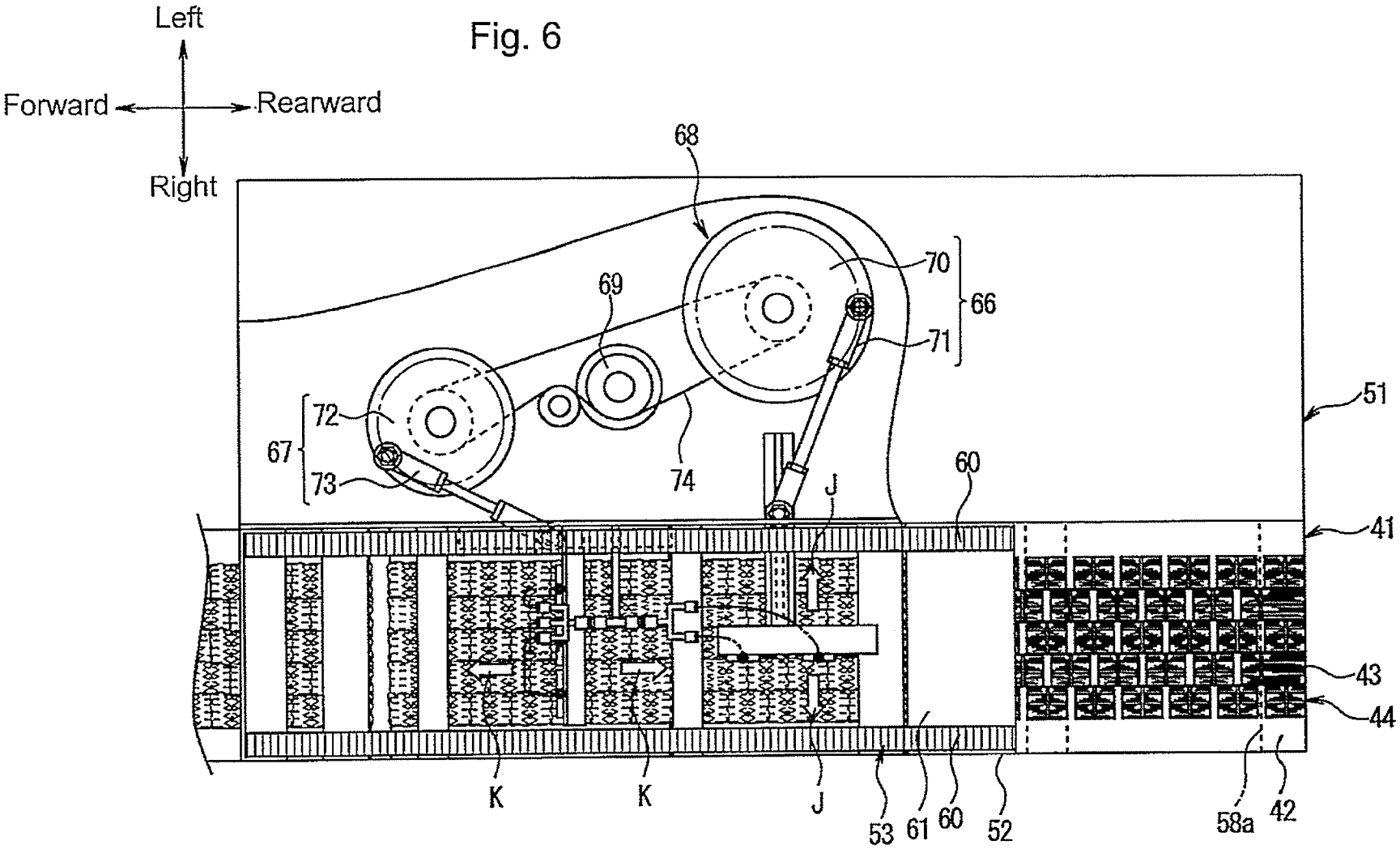
FIG. 6 is a plan view illustrating the configuration of the raising apparatus for the cleaning portion in the cleaning tool according to the second embodiment.

The pressing section 53 is for pressing the cleaning tool 41 transported by the belt member 56 against the belt member 56 and is constituted by pressing section belt members 60, a pressing section driving roller 61, pressing section driven rollers 62*a* and 62*b*, and a pressing section tension roller 63. The pressing section belt members 60 are provided to form a pair in the right and left direction as illustrated in FIG. 6 and is configured to be moved at the same speed as the transport speed of the belt member 56 by the rotation of the pressing section driving roller 61. The pressing section belt members 60 are configured to press the mounting portions (which are parts of the area where the fiber layers 43 are not formed and are formed at both right and left edges along the longitudinal direction of the cleaning tool 41) in the cleaning tool 41 transported by the belt member 56 against the belt member 56.

The pressing section driving roller 61 is for transporting the pressing section belt member 60 and is provided to be positioned on the rear end portion side of the inner periphery of the pressing section belt member 60. The pressing section driving roller 61 is configured to be rotated in a direction H in FIG. 5 by a driving motor (not illustrated). As the configuration of the driving motor and a mechanism for transmitting power from the driving motor to the pressing section driving roller 61, a hitherto well-known mechanism may be employed.

The pressing section driven rollers 62*a* and 62*b* are for overlaying the pressing section belt member 60 together with the pressing section driving roller 61 and are provided on the downstream side in relation to the pressing section driving roller 61. The pressing section driven rollers 62*a* and 62*b* are provided substantially at the same height position as that of the pressing section driving roller 61 as the pressing section driven rollers 62*a* and 62*b* approach the belt member 56 and are installed so that the pressing section belt member 60 transported by the pressing section driving roller 61 and the pressing section driven rollers 62*a* and 62*b* is moved in the same height position. In addition, the pressing section driven rollers 62*a* and 62*b* are provided at higher positions than those of the pressing section driven rollers 62*a* and 62*b*.

The pressing section tension roller 63 is for applying a predetermined tension to the pressing section belt member 60 overlaid by the pressing section driving roller 61 and the pressing section driven rollers 62*a* and 62*b*. The pressing section tension roller 63 is positioned on the inner peripheral side of the pressing section belt member 60 and is provided to apply a tension to the pressing section belt member 60 in the outward direction.

Regarding the pressing section belt member 60, the pressing section driving roller 61, the pressing section driven rollers 62*a* and 62*b*, and the pressing section tension roller 63, the pressing section belt member 60 revolves as the pressing section driving roller 61, the pressing section driven rollers 62*a* and 62*b*, and the pressing section tension roller 63 are rotated in the direction H in FIG. 5 by the driving of the driving motor (not illustrated). At this time, the revolving pressing section belt member 60 moves in the direction I shown in FIG. 5 at the potion the cleaning tools 41 are pressed and moved.

The speed of the pressing section belt member 60 when the cleaning tool 41 is transported is preferably the same as the speed at which the belt member 56 is moved in the transport direction I from the viewpoint of stable transportation of the cleaning tool 41.

The blowing part 54 is used to blow the compressed air toward the fiber layers 43 to raise the fibers of the fiber layers 43. In the blowing part 54, first and second blowing parts 64 and 65 and a blowing driving device 68 having a first driving device 66 for driving the first blowing part 64 and a second driving device 67 for driving the second blowing part 65 are provided. As illustrated in FIGS. 5 and 6, the first blowing part 64 is disposed on the upstream side of the raising apparatus 51, and the second blowing part 65 is disposed on the downstream side of the raising apparatus 51.

The blowing driving device 68 includes a driving roller 69, a first driven roller 70 and a first crank member 71 constituting the first driving device 66, a second driven roller 72 and a second crank member 73 constituting a second driving device 67, and a driving belt member 74 overlaid between the driving roller 69, the first driven roller 70, and the second driven roller 72. The driving roller 69 is for transporting the driving belt member 74. The driving roller 69 is provided to be positioned on the inner peripheral side of the driving belt member 74. The driving roller 69 is configured to be rotated by a driving motor (not illustrated). In addition, as the configuration of the driving motor and a mechanism for transmitting power from the driving motor to the driving roller 69, a hitherto well-known mechanism may be employed.

The first driven roller 70 is for allowing the driving belt member 74 to be overlaid thereon together with the driving roller 69 and the second driven roller 72 and transmitting the rotating motion transmitted from the driving belt member 74 to the first crank member 71. As illustrated in FIG. 6, the first driven roller 70 is formed in a stepped shape such that the driving belt member 74 is overlaid by the small-diameter portion thereof and the first crank member 71 is connected to the large-diameter portion thereof.

The first crank member 71 is configured so that one end is connected to the large-diameter portion of the first driven roller 70 and the other end is connected to the first blowing part 64. The first crank member 71 is for converting the rotating motion of the first driven roller 70 into a linear reciprocating motion. That is, the first crank member 71 allows the first blowing part 64 connected to the other end thereof to perform the linear reciprocating motion when the first driven roller 70 performs the rotating motion.

The second driven roller 72 is for allowing the driving belt member 74 to be overlaid thereon together with the driving roller 69 and the first driven roller 70 and transmitting the rotating motion transmitted from the driving belt member 74 to the second crank member 73. As illustrated in FIG. 6, the second driven roller 72 is formed in a stepped shape like the first driven roller 70 such that the driving belt member 74 is overlaid by the small-diameter portion thereof and the second crank member 73 is connected to the large-diameter portion thereof.

The second crank member 73 is configured so that one end is connected to the large-diameter portion of the second driven roller 72 and the other end is connected to the second blowing part 65. The second crank member 73 is for converting the rotating motion of the second driven roller 72 into a linear reciprocating motion, and thus the second blowing part 65 connected to the other end thereof performs the linear reciprocating motion when the second driven roller 72 performs the rotating motion.

A convention elements may be available to transmit the movement if the first driven roller 70 and the second driven roller 72 allow the driving belt member 74 to be overlaid thereon together with the driving roller 69, and moreover, the first driven roller 70 can transmit motions to the first crank member 71 and the second driven roller 72 can transmit motions to the second crank member 73. In addition, a hitherto well-known structure may be used as long as the first crank member 71 can convert the motions transmitted from the first driven roller 70 into the linear reciprocating motion so as to be transmitted to the first blowing part 64 and moreover the second crank member 73 can convert the motions transmitted from the second driven roller 72 into the linear reciprocating motion so as to be transmitted to the second blowing part 65.

The first blowing part 64 has two first nozzles 75 arranged in a direction parallel to the transport direction I. The first blowing part 64 is connected to the other end of the first crank member 71 and as illustrated in FIG. 6, is configured to move in a direction J orthogonal to the transport direction I. In addition, the second blowing part 65 has three second nozzles 76 arranged in the direction orthogonal to the transport direction I. The second blowing part 65 is connected to the other end of the second crank member 73 and as illustrated in FIG. 6, is configured to move in a direction K parallel to the transport direction I. In this embodiment, the direction in which the first nozzles 75 reciprocate and the direction in which the second nozzles 76 reciprocate are orthogonal to each other. However, the directions are not limited to be orthogonal to each other and may intersect each other.

As illustrated in FIG. 8, each of the first nozzles 75 and the second nozzles 76 is configured so that the front end surface thereof is formed as a blowing hole formation surface 78 in which a plurality of blowing holes 77 for blowing the compressed air toward the fiber layers 43 are formed, and the compressed air supplied from a gas supply pipe 79 connected to the rear end side thereof is ejected from the blowing holes 77.

Next, the action of the raising apparatus 51 of this embodiment will be described. As illustrated in FIG. 5, when the raising apparatus 51 starts to drive, the driving motor starts to drive and the driving roller 57 starts to rotate in the direction G such that the belt member 56 of the transporting section 52 starts to move in the transport direction (the direction I). In addition, the pressing section driving motor included in the pressing section 53 also starts rotational driving, the pressing section driving roller 57 starts to rotate in the direction H, and the pressing section belt member 56 also starts to move. Moreover, the first blowing part 64 reciprocates in the direction J in FIG. 6, and the second blowing part 65 reciprocates in the direction K in FIG. 6.

Here, when the cleaning tool 41 is installed on the belt member 56, the cleaning tool 41 is transported in the direction I by the belt member 56. When the cleaning tool 41 is transported in the direction I by the belt member 56, the mounting portion where the fiber layers 43 are not formed is pressed by the pressing section belt member 56 against the belt member 56. In addition, the cleaning tool 41 is further transported in the direction I while maintaining this state. At this time, the movement speed of the belt member 56 and the movement speed of the pressing section belt member 56 are the same, and thus there is no concern of the pressed and fixed cleaning tool 41 being wrinkled and the base material sheet 42 of the cleaning tool 41 being broken.

When the cleaning tool 41 pressed against the belt member 56 as such is transported to the first blowing part 64, the compressed air ejected from the first nozzles 75 of the first blowing part 64 is blown. At this time, since the first blowing part 64 reciprocates in the direction J, the compressed air ejected from the first nozzles 75 is blown all over the fiber layers 43. The compressed air is ejected in the direction orthogonal to the fiber layers 43 and is blown toward the fiber layers 43 and the base material sheet 42. Thereafter, the compressed air comes into contact with the fiber layers 43 or the base material sheet 42 and flows while changing its direction to the direction parallel to the fiber layers 43 or the base material sheet 42. Here, the flow of the compressed air becomes turbulence that moves while flowing between the fibers constituting the fiber layers 43 and passes between the fibers while applying a force to raise the fibers. The force applied by the compressed air to the fibers at this time is a force at a degree to raise the fibers and an excessive force is not applied to the fibers. Therefore, there is no concern of the fibers being cut during the raising and it is possible to reliably raise the fibers.

The cleaning tool 41 raised by the first blowing part 64 in this manner is further moved in the direction I and is transported to the second blowing part 65. Since the second blowing part 65 reciprocates in the direction orthogonal to the direction in which the first blowing part 64 reciprocates, the fibers are further raised by a flow in a direction different from the flow of the compressed air ejected by the first blowing part 64. Therefore, it is possible to reliably raise the fibers that could be sufficiently raised by the first blowing part 64.

The fibers of the fiber layers 43 raised by the first blowing part 64 and the second blowing part 65 in this manner are erected and tangled and thus enter a bulky state. Here, since a large number of fiber layer blocks are formed in the cleaning tool 41, the fibers are erected from the heat sealed portion 80 as the base point in each of the fiber layer block, and thus a bulky fiber layer block having a round shape is formed. Accordingly, the fiber layers 43 having greater volumes overall are formed on the base material sheet 42. The cleaning tool 41 in which a large number of bulky fiber layer blocks having round shapes are formed in this manner is thereafter transported to the downstream side and is received by an accommodation portion (not illustrated).

As described above, even in the raising apparatus 51 according to this embodiment, the fibers of the fiber layers 43 can be raised by blowing the compressed air toward the fiber layers 43, and thus an excessive external force is not applied to the fibers. Therefore, even in a case where the diameter of the fiber is small and the length of the fiber is large, there is no concern of the fibers being cut, and accordingly, the cleaning tool 41 having an improved waste collecting ability can be manufactured.

In addition, even in the raising method according to this embodiment, turbulence is more likely to be formed by the flow of the compressed air. Therefore, the fibers of the fiber layers 43 can be raised evenly, and it is possible to achieve more efficient work.

In addition, in this embodiment, after the compressed air is blown toward the cleaning tool 41 by the first blowing part 64, the compressed air is further blown by the second blowing part 65. However, this process order may be reversed. In this embodiment, blowing of the compressed air toward the cleaning tool 41 is performed two times. However, the number of blowing operations is not limited to two. In addition, in this embodiment, the first blowing part 64 moves in the direction orthogonal to the transport direction and the second blowing part 65 moves in the direction parallel to the transport direction. However, when the movement direction of the first blowing part 64 and the movement direction of the second blowing part 65 intersect each other, for example, the first blowing part 64 and the second blowing part 65 may intersect and move at a predetermined angle with respect to the transport direction.

While the first embodiment and the second embodiment according to the invention have been described above, the embodiments are only examples of the embodiment of the invention and can be appropriately modified without departing from the gist of the invention.

INDUSTRIAL APPLICABILITY

The invention can provide a cleaning tool which raises fibers by blowing compressed air toward fiber layers constituting a cleaning portion in the cleaning tool, thereby exhibiting an excellent property of wiping up waste.

The invention claimed is:

1. A raising apparatus for a cleaning portion in a cleaning tool, which raises fibers of the cleaning portion in the cleaning tool, comprising:

a supporting member configured to support the cleaning tool;

wherein the cleaning tool has a pocket portion comprising a first end and a second end, and wherein at least one of the first end and the second end is open; and wherein the supporting member is configured for insertion into the pocket portion;

a blowing part configured to blow gas towards the fibers of the cleaning portion to raise the fibers;

wherein the blowing part includes a nozzle having a blowing hole for blowing the gas toward the fibers of the cleaning tool; and wherein a gas pressure from the gas causes the cleaning portion to rotate while raising the fibers of the cleaning portion of the cleaning tool; and a driving device;

wherein the driving device is configured to transmit a force to move the nozzle; and wherein a concentration of the gas pressure on the fibers of the cleaning portion moves relative to the cleaning portion when the nozzle moves.

2. The raising apparatus for a cleaning portion in a cleaning tool according to claim 1 wherein the nozzle moves in a reciprocating motion.

3. The raising apparatus for a cleaning portion in a cleaning tool according to claim 2 wherein during the reciprocating motion of the nozzle reciprocates between a position corresponding to an upper end portion of the cleaning tool and a position corresponding to a lower end portion of the cleaning tool.

4. The raising apparatus for a cleaning portion in a cleaning tool according to claim 2 wherein the cleaning portion rotates about the supporting member.

5. The raising apparatus for a cleaning portion in a cleaning tool according to claim 4, further comprising:

a detaching part wherein the cleaning tool is ejected from the supporting member by a detaching nozzle that ejects gas towards the cleaning tool.

6. The raising apparatus for a cleaning portion in a cleaning tool according to claim 1 wherein the cleaning portion rotates about the supporting member.

7. The raising apparatus for a cleaning portion in a cleaning tool according to claim 1 wherein the supporting member is a columnar member with a proximal end and a distal end.

8. The raising apparatus for a cleaning portion in a cleaning tool according to claim 7 wherein the pocket portion is inserted over the distal end of the columnar member.

9. The raising apparatus for a cleaning portion in a cleaning tool according to claim 7 wherein the supporting member has a vertical axial direction when the gas causes the cleaning portion to rotate while raising the fibers of the cleaning portion.

10. The raising apparatus for a cleaning portion in a cleaning tool according to claim 1, further comprising:

a transporting member that transports the cleaning tool; and wherein the support member is provided on the transporting member.

11. The raising apparatus for a cleaning portion in a cleaning tool according to claim 10, wherein the transporting section includes a belt-like member that transports the cleaning tool, a driving roller that transports the belt-like member, and a driven roller that allows the belt-like member to be overlaid thereon together with the driving roller.

12. The raising apparatus for a cleaning portion in a cleaning tool according to claim 11 wherein there is a plurality of supporting members.

13. The raising apparatus for a cleaning portion in a cleaning tool according to claim 1 wherein the cleaning tool is ejected from the supporting member by the gas pressure.

14. The raising apparatus for a cleaning portion in a cleaning tool according to claim 1, further comprising:

a detaching part wherein the cleaning tool is ejected from the supporting member by a detaching nozzle that ejects gas towards the cleaning tool.

15. The raising apparatus for a cleaning portion in a cleaning tool according to claim 14 wherein the supporting member has a first orientation when the gas causes the cleaning portion to rotate while raising the fibers of the cleaning portion and a second orientation different than the first orientation when the cleaning tool is ejected from the supporting member.

16. The raising apparatus for a cleaning portion in a cleaning tool according to claim 1 wherein there is a plurality of supporting members.

* * * * *